United States Patent [19]

Schick et al.

[11] Patent Number: 4,463,201

[45] Date of Patent: Jul. 31, 1984

[54] PROCESS FOR MAKING SYNTHETIC LUBRICATING OILS

[75] Inventors: John W. Schick, Cherry Hill; Robert M. Gemmill, Jr., Pitman, both of N.J.

[73] Assignee: Mobil Oil Corporation, New York, N.Y.

[21] Appl. No.: 460,705

[22] Filed: Jan. 24, 1983

Related U.S. Application Data

[63] Continuation of Ser. No. 367,706, Apr. 12, 1982, abandoned.

[51] Int. Cl.[3] ..... C10L 1/16; C07C 2/02

[52] U.S. Cl. ..... 585/10; 585/18; 585/255; 585/512; 585/522; 585/523; 585/524; 585/520; 585/532

[58] Field of Search ..... 585/10, 18, 255, 329, 585/512, 522, 523, 524, 520, 532

[56] References Cited

U.S. PATENT DOCUMENTS 3,737,477 6/1973 Stearns et al. ..... 585/255

3,945,912 3/1976 Kumert et al. ..... 208/25

*Primary Examiner*—Curtis R. Davis

*Attorney, Agent, or Firm*—Alexander J. McKillop; Michael G. Gilman; Howard M. Flournoy

[57] ABSTRACT

High quality synthetic lubricating oils are provided when certain olefinic monomers such as ethylene, propylene and a third 1-olefin are copolymerized and thereafter dewaxed by means of a urea adduction process.

8 Claims, No Drawings

PROCESS FOR MAKING SYNTHETIC LUBRICATING OILS

This is a continuation of copending application Ser. No. 367,706, filed Apr. 12, 1982 and now abandoned.

BACKGROUND OF THE INVENTION

1. Field of the Invention

The invention is directed to synthetic lubricating oils comprising mixed polymers of ethylene, propylene and a third olefinic monomer such as 1-butene or 1-hexene. The invention is more particularly directed to a novel process of producing high quality synthetic oils by the copolymerization of ethylene, propylene and a third alpha or 1-olefin using a Zeigler-Natta catalyst system followed by a simplified dewaxing technique, urea adduction.

2. Summary of the Prior Art

The preparation of synthetic oils from ethylene and propylene using Ziegler-Natta catalysis is not new. The existing art refers to low viscosity oils which are obtained by thermal cracking and, very likely, deep dewaxing. The art also describes high molecular weight, solid copolymers used as viscosity index improving additives. Thus in general the polymerization of olefinic mixtures using a Ziegler-type catalyst is known.

U.S. Pat. No. 3.923,919 discloses that in producing synthetic hydrocarbon lubricating oils, the attainment of high viscosity index is generally due to the presence of at least 29 mol. % of ethylene to provide an oil with low pour point and high viscosity index.

Other U.S. Pat. Nos. with similar or related disclosures are 3,676,521, 3,737,477 and 3,851,011.

However, none of these patents or the prior art in general discloses or suggests a process wherein urea adduction is incorporated into the polymerization reaction product work-up procedure as a means of producing high quality synthetic oils. The prior art seems to indicate that thermal cracking and deep dewaxing are necessary to produce high quality oils having low viscosity and low pour point.

We have found that copolymers of ethylene and propylene alone produce waxy oils having high VI, high viscosity and high pour point (Table 1) and that conventional, low temperature dewaxing (MEK-toluene) does not adequately reduce viscosity or pour point (semi-solid @ R.T. to —> −10° F.) and seriously reduces finished oil yield (approx. 40% loss versus a 2–4% loss using the system or process described herein). This large 40% loss explains the prior art need for thermal cracking.

Urea adduction is well known and has been used in the past to treat aviation fuels and waxy lubes to preferentially remove wax-like components and thereby improve low temperature flow properties and pour point. The urea dewaxing method was found inappropriate to dewax typical ethylene-propylene copolymer oils (Table 1, ex. 2) due to their high average molecular weight and high wax content. However, the method was found very effective with an ethylene-propylene terpolymer oil in accordance with this invention containing for example either 1-butene or 1-hexene (Table 2, ex. 1, 2 and 4 vs. 3). The use of urea adduction as opposed to prior art dewaxing techniques results in a dramatic and unexpected change in pour point (see Table 2).

Fuel economy and fuel efficient automotive oils are of great interest and importance today. Lubricant viscosity at engine operating conditions is a major contributing factor to this efficiency. Many efforts to formulate fuel-efficient synthetic and semi-synthetic lubricants are currently underway. This invention makes possible the development of semi-synthetic and fully synthetic formulated oils with appreciably reduced viscosity at low pour point. Friction modification through reduced viscosity is, of course, one possible way to achieve improved fuel economy benefits.

SUMMARY OF THE INVENTION

In accordance with the invention, high quality synthetic oils are provided by a novel process comprising the incorporation of a third monomer such as 1-hexene into ethylene-propylene copolymers which thereby, lowers the average molecular weight, viscosity and pour point with virtually little or no effect on viscosity index (see Table 2, ex 2; and 4 vs 3). Without said third monomer these $C_2$–$C_3$ copolymer oils have high VI, high viscosity and high pour point (Table 1). The incorporation of a simplified urea adduction process into the reaction product work-up thereby drastically lowers the pour point and 0° F. viscosity with no change in VI or viscosity at 40° C. and 100° C. The alpha-olefins are most usually reacted in a wt. ratio of ethylene to propylene to third monomer of from about 10 to 51.5 to 38.5 wt. % plus or minus 2 wt. % for each of said olefins.

Generally speaking, the process is as follows: ethylene, propylene and a suitable third alpha-olefin are polymerized in any convenient manner known to the art and thereafter the terpolymer thus produced is subjected to urea adduction. That is, after polymerization, catalyst removal and filtration, the waxy terpolymer oil is treated with, for example, 40% by weight urea in a saturated absolute alcoholic, e.g., methanol solution. The insoluble urea-wax adduct which forms immediately is removed by rapid filtration through, e.g., a glass frit filter. The filtrate, after water washing, solvent removal and vacuum filtration yields a crystal clear oil. Oils processed in this manner showed only about a 2% to 4% weight loss. The oil is then vacuum topped to achieve the desired flash point. The oil at this point is a finished oil since hydrogenation occurs during the polymerization reaction in which a vanadium-aluminum-hydrogen catalyst system is employed.

Hydrogen pressure within the below defined limits is extremely important to the success of this novel process. Hydrogen pressures from about 250 to about 2,500 psig and preferably from about 800 to 1,500 psig are utilized herein. Reaction temperatures may vary from room temperature to about 150° F. Preferable is a temperature range of from about 60°–90° F.

The optimum Ziegler-Natta catalyst system found for this process consisted of vanadium oxytrichloride and diethyl aluminum chloride or ethyl aluminum sesquichloride at said high hydrogen pressure. Other catalysts such as titanium tetrachloride (in place of vanadium) function similarly to Friedel-Crafts catalysts such as $AlCl_3$ to produce low VI, non-hydrogenated oils. However, any suitable Ziegler-Natta catalyst system may be used. The mole ratio of aluminum to vanadium may vary from about 3:1 to about 9 or 10:1 depending on the specific alkyl aluminum compound used.

Fluids of this type are also highly useful as base stocks for high quality synthetic lubricants. They provide an alternative to decene polymer oil, a highly desirable base stock, which is expensive and can at times be in limited supply. Presently, the best olefin derived polymer fluids are fully dependent upon the availability of 1-decene. The use of this process would allow refinery produced ethylene and propylene and other alpha-olefins to be of significant commercial value as an alternative, particularly if 1-decene supply becomes a problem. Accordingly, the terpolymers embodied herein may be blended with any suitable lubricating media such as oils of lubricating viscosity including hydrocracked lubricating oils, hydraulic oils, automotive oils, gear oils, transmission fluids, waxes, greases and other forms of lubricant compositions selected from mineral oils, synthetic oils or mixtures thereof. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl benyl) adiptate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxy phenyl) ether, phenoxy penylether, etc.

DESCRIPTION OF SPECIFIC EMBODIMENTS

Table 1 is a profile of typical "high quality" prior art ethylene-propylene copolymers having high VI, high viscosity, high pour point, and high wax content.

Table 2 illustrates polymer oils (Ex. 1, 2 and 4) in accordance with this invention. Table 2 also illustrates the effectiveness of the dewaxing technique (urea adduction) used herein. It can be readily discerned from an examination of tables 1 and 2 the process of this invention results in a copolymer which is outside the limits of prior art copolymers. For example, U.S. Pat. No. 3,676,521 teaches that at least 29 mol percent ethylene is required to produce high quality ethylene-propylene copolymer oils. The maximum used herein is about 10 wt. %±2%.

EXAMPLE 1

The polymerization was performed in the following sequence in a one-gallon stirred autoclave having all the necessary attendant equipment:

One liter of n-hexane solvent was charged to the autoclave with cooling water at 65° F. circulating through the jacket. The autoclave was purged with nitrogen to remove all air. Under nitrogen, diethyl aluminum chloride co-catalyst (0.2475 mole) in n-heptane was injected via syringe into the solvent and vanadium oxytrichloride catalyst (0.0165 mole) in n-heptane was then injected in the same manner. The unit was pressurized with 1,200 psig of hydrogen. (Here hydrogen is a chain terminator which controls molecular weight and also regenerates the catalyst while simultaneously hydrogenating the polymer product as it is formed). Simultaneously, 2.4 moles (10.2 wt. %) of ethylene was charged to the unit via a calibrated rotameter while the mixture of propylene (8.0 moles, 51.3 wt. %) and 1-hexene (3.0 moles, 38.5 wt. %) was charged to the unit from a calibrated pressurized burette.

After the monomer feed period and hold period, 1-propanol was added to quench the catalyst. The stirrer was then stopped and unreacted hydrogen and gaseous feedstock were vented through a wet test meter. The reaction product was then first washed with dilute HCl, and dilute $NaHCO_3$ and finally with distilled water and the product-solvent mixture filtered through fluted filter paper to remove solid polymer. The hexane solvent and any light products were distilled off to a pot temperature of 180° C. at atmospheric pressure.

The total polymer oil product was vacuum topped using a 12" Vigreux distillation column to a head temperature of 125° C. at 1.0 mm in order to obtain a residual topped product having approximately a 400° F. flash point. One half of the topped oil was vacuum filtered through HiFlo filter aid to yield the non-dewaxed oil described in Table 2. The other half of the topped oil was mixed with n-hexane and treated with 40% by weight of urea in a saturated absolute methanol solution. The solid, white urea-wax adduct, which formed instantly, was removed by filtration. The dewaxed product-solvent mixture was water washed and the solvent removed by distillation. The final, dewaxed polymer oil product was vacuum filtered through HiFlo filter oil to give a clear, water-white oil as described in Table 2.

EXAMPLE 2

The procedure of Example 1 was repeated except that 4.5 moles (38.5 wt. %) of 1-butene were used as the third monomer and 0.1475 mole of $(Et)_3AlCl_3$ was used as the co-catalyst.

EXAMPLE 3

The procedure of Example 1 was followed, however, this example did not use a third mononer, thereby changing the wt. ratio of ethylene to propylene (16.7 to 83.3 wt. %). Also 0.0246 mole of $(Et)_3AlCl_3$ was used and the resultant polymer oil was not subject to urea adduction.

EXAMPLE 4

The procedure of Example 1 was repeated except that 0.0246 mole of $(Et)_3AlCl_3$ was used.

TABLE 1

TYPICAL ETHYLENE-PROPYLENE COPOLYMER OILS

| Example No. | A | B* | C | D |
|---|---|---|---|---|
| Solvent n-hexane | 1.0 | 1.0 | 1.0 | 1.0 |
| $C_2H_4$ - moles | 2.4 | 2.4 | 2.4 | 2.4 |
| wt. % | 16.7 | 16.7 | 16.7 | 16.7 |
| $C_3H_6$ - moles | 8.0 | 8.0 | 8.0 | 8.0 |
| wt. % | 83.3 | 83.3 | 83.3 | 83.3 |
| Catalyst - type | $VOCl_3$ | $VOCl_3$ | $VOCl_3$ | $VOCl_3$ |
| moles | 0.0165 | 0.0165 | 0.0165 | 0.0165 |
| Co-Catalyst type | $(Et)_2AlCl$ | $(Et)_2AlCl$ | $(Et)_2AlCl$ | $(Et)_3Al_2Cl_3$ |
| moles | 0.1475 | 0.1475 | 0.1475 | 0.0246 |
| Al:V mole ratio | 9:1 | 9:1 | 9:1 | 3:1 |
| Hydrogen psig | 400 | 800 | 1200 | 800 |
| Reaction Temp., °F. | 80 | 75 | 73 | 77 |
| Feed Time hrs. | 1.0 | 1.5 | 1.5 | 1.5 |

TABLE 1-continued

| TYPICAL ETHYLENE-PROPYLENE COPOLYMER OILS | | | | |
|---|---|---|---|---|
| Example No. | A | B* | C | D |
| Hold Time hrs. | 1.0 | 3.0 | 3.0 | 3.0 |
| Conversions - % of Feed | | | | |
| Total conversion | 63.0 | 65.3 | 52.1 | 83.5 |
| Solid polymer | 9.6 | 13.0 | 8.9 | 10.0 |
| Total oil | 53.4 | 52.3 | 43.2 | 73.5 |
| Topped oil | 42.1 | 39.4 | 23.3 | 57.4 |
| Properties | | | | |
| Appearance | opaque, white | opaque, white | opaque, white | opaque, white |
| KV @ 100° C. | 47.59 (210° F.) | 28.50 | 21.07 | 31.46 |
| KV @ 40° C. | 494.64 (100° F.) | 204.30 | 161.40 | 278.30 |
| VI | 162 | 179 | 154 | 154 |
| Pour °F. | +10 | >0 | >0 | >0 |
| Flash °F. | — | 400 | — | 400 |

*Attempted dewaxing by urea adduction.

TABLE 2

| ETHYLENE-PROPYLENE TERPOLYMER OILS - EFFECT OF THIRD MONOMER AND UREA ADDUCTION | | | | | |
|---|---|---|---|---|---|
| Example No. | 1 | | 2 | 3 | 4 |
| Solvent n-hexane | 1.0 | | 1.0 | 1.0 | 1.0 |
| $C_2H_4$ - moles | 2.4 | | 2.4 | 2.4 | 2.4 |
| wt. % | 10.2 | | 10.2 | 16.7 | 10.2 |
| $C_3H_6$ - moles | 8.0 | | 8.0 | 8.0 | 8.0 |
| wt. % | 51.3 | | 51.3 | 83.3 | 51.3 |
| Third monomer - type | 1-$C_6H_{12}$ | | 1-$C_4H_8$ | — | 1-$C_6H_{12}$ |
| moles | 3.0 | | 4.5 | — | 3.0 |
| wt. % | 38.5 | | 38.5 | — | 38.5 |
| Catalyst - type | $VOCl_3$ | | $VOCl_3$ | $VOCl_3$ | $VOCl_3$ |
| moles | 0.0165 | | 0.0165 | 0.0165 | 0.0165 |
| Co-catalyst - type | $(Et)_2AlCl$ | | $(Et)_2AlCl$ | $(Et)_3AlCl_3$ | $(Et)_3AlCl_3$ |
| moles | 0.2475 | | 0.1475 | 0.0246 | 0.0246 |
| Al:V mole ratio | 9:1 | | 9:1 | 3:1 | 3:1 |
| Hydrogen psig | 1200 | | 1200 | 800 | 1200 |
| Reaction Temp., °F. | 75 | | 74 | 77 | 73 |
| Feed Time hrs. | 1.5 | | 1.5 | 1.5 | 1.5 |
| Hold Time hrs. | 3.0 | | 3.0 | 3.0 | 3.0 |
| Conversions - % of Feed | | | | | |
| Total conversion | 48.1 | | 38.0 | 83.5 | 57.9 |
| Solid Polymer | 3.2 | | 3.9 | 10.0 | 2.6 |
| Total Oil | 44.9 | | 34.1 | 73.5 | 55.3 |
| Topped Oil | 22.8 | | 17.9 | 57.4 | 34.4 |
| Properties | w/o urea | with urea | with urea | w/o urea | with urea |
| Appearance | hazy, white | clear | clear | hazy, white | clear |
| KV @ 100° C. | 6.66 | 6.73 | 13.22 | 31.46 | 12.05 |
| KV @ 40° C. | 34.85 | 35.64 | 86.07 | 278.30 | 85.22 |
| VI | 150 | 149 | 154 | 154 | 135 |
| KV @ 0° F. | 6640. | 1430. | — | — | — |
| Pour °F. | −35 | <−65 | −60 | >0 | <−65 |
| Flash °F. | 375 | 375 | — | 400 | 375 |

It is understood that the above specification is not meant to be a precise limitation of this invention. Variations of the exemplary data apparent to one of ordinary skill in the art are included herein.

We claim:

1. A process for preparing a synthetic lubricating oil from a mixture consisting essentially of ethylene, propylene and a higher alpha-olefin having from about 4 to about 10 carbon atoms comprising reacting in a suitable reaction medium under polymerization conditions about 10% by weight ethylene, with propylene and said higher alpha-olefin in the presence of (a) an aluminum-containing catalyst, (b) a vanadium-containing catalyst, and (c) hydrogen with the mole ratio of aluminum to vanadiun varying from about 3:1 to about 9–10:1 and thereafter subjecting the resultant waxy terpolymer oil to dewaxing via urea adduction.

2. The process of claim 1 wherein the reaction is carried out under hydrogen pressure of from 250 to about 2,500 psig and at a temperature of from about 60° to 150° F.

3. The process of claim 2 wherein the hydrogen pressure is from 800 to 1500 psig and the temperature is from 60° to 90° F.

4. The process of claim 1 wherein the weight ratio of propylene to ethylene to the higher alpha-olefin is from about 10 to 51.5 to 38.5 wt. %±2.

5. The process of claim 1 wherein the higher alpha-olefin is selected from 1-butene and 1-hexene.

6. The process of claim 1 wherein the vanadium and aluminum containing catalysts are a vanadium oxyhalide and an alkyl aluminum halide.

7. The process of claim 5 wherein the vanadium oxyhalide is vanadium oxytrichloride and the aluminum halide is ethyl aluminum sesquichloride or diethyl aluminum chloride.

8. A composition comprising a minor amount of a synthetic oil prepared as in claims 5 or 7 and a major amount of an oil of lubricating viscosity selected from synthetic, mineral or mixed synthetic/mineral oils.

* * * * *

UNITED STATES PATENT AND TRADEMARK OFFICE

CERTIFICATE OF CORRECTION

PATENT NO. : 4,463,201

DATED : July 31, 1984

INVENTOR(S) : John W. Schick and Robert M. Gemmill, Jr.

It is certified that error appears in the above—identified patent and that said Letters Patent is hereby corrected as shown below:

Column 3, line 19, "benyl)" should be --hexyl)--.

Table 1, line 3, symbol ℓ for liter omitted after "solvent n-hexane".

Signed and Sealed this

*Fourteenth* Day of *May 1985*

[SEAL]

*Attest:*

DONALD J. QUIGG

*Attesting Officer* *Acting Commissioner of Patents and Trademarks*